US006053400A

United States Patent [19]

Rea

[11] Patent Number: 6,053,400

[45] Date of Patent: Apr. 25, 2000

[54] CONTAINER HAVING EXPANDING OR CONTRACTING END CLOSURE

[75] Inventor: Keith Rea, Florence, S.C.

[73] Assignee: Sonoco Development, Inc., Hartsville, S.C.

[21] Appl. No.: 09/253,087

[22] Filed: Feb. 19, 1999

Related U.S. Application Data

[63] Continuation-in-part of application No. 09/036,666, Mar. 4, 1998.

[51] Int. Cl.[7] ..... B65D 5/00

[52] U.S. Cl. ..... 229/101; 229/4.5; 229/5.5; 220/609; 220/620

[58] Field of Search ..... 215/11.3; 220/609, 220/619, 620; 229/4.5, 101, 5.5, 5.6; 306/830

[56] References Cited

U.S. PATENT DOCUMENTS

| | | | |
|---|---|---|---|
| Re. 20,057 | 8/1936 | Alexander | 220/609 X |
| 82,766 | 10/1868 | Stone | 220/620 |
| 272,921 | 2/1883 | Tuckett | 220/620 |
| 1,257,949 | 2/1918 | Adelson | 220/609 X |
| 1,428,705 | 9/1922 | Pickens | 220/609 X |
| 1,904,741 | 4/1933 | Lorber . | |
| 1,988,091 | 1/1935 | Schumacher . | |
| 2,027,430 | 1/1936 | Hansen | 220/609 X |
| 2,208,744 | 7/1940 | Bergerioux | 220/609 X |
| 2,244,940 | 6/1941 | Carruth | 229/117.01 |
| 2,628,912 | 2/1953 | Horan | 215/11.3 X |
| 2,649,995 | 8/1953 | Muskin | 222/92 |
| 2,681,284 | 6/1954 | Graves . | |
| 3,140,034 | 7/1964 | Wyman et al. | 220/609 X |
| 3,243,069 | 3/1966 | Duerme | 215/11.3 |
| 3,506,459 | 4/1970 | Parlour . | |
| 3,556,815 | 1/1971 | Fujiwara | 220/609 X |
| 4,279,351 | 7/1981 | Vertes . | |
| 4,381,315 | 4/1983 | Yong et al. . | |
| 4,408,698 | 10/1983 | Ballester . | |
| 4,415,598 | 11/1983 | Chen et al. . | |
| 4,560,063 | 12/1985 | Muller . | |
| 4,836,398 | 6/1989 | Leftault, Jr. et al. . | |
| 4,836,400 | 6/1989 | Chaffey et al. . | |
| 4,887,730 | 12/1989 | Touzani . | |
| 4,892,214 | 1/1990 | Hamaguchi et al. | 220/620 |
| 5,476,213 | 12/1995 | Suski . | |

FOREIGN PATENT DOCUMENTS

| | | |
|---|---|---|
| 0 208 352 A1 | 1/1987 | European Pat. Off. . |
| 1 389 226 | 6/1965 | France . |
| WO 88 07481 | 10/1988 | WIPO . |

*Primary Examiner*—Stephen P. Garbe
*Assistant Examiner*—Tri M. Mai
*Attorney, Agent, or Firm*—Alston&Bird LLP

[57] ABSTRACT

A container has a movable end closure for accommodating expansion or contraction of the product packaged therein. The container includes a hollow body portion with opposed open ends and an inside surface and an end closure positioned at each of the open ends of the hollow body portion and secured thereto for closing the container with product contained therein. One of the end closures is of a generally cup-shaped configuration and has a radially-extending central portion of generally the same configuration and dimensions as the inside surface of the body portion and an accordion-folded sidewalk extending axially from the central portion toward the body portion open end to define a free end area secured to the inside surface of the body portion at the open end. This end closure is positioned so that the central portion may axially move along the body portion inside surface toward or away from the body portion open end by contraction or expansion of the end closure accordion-folded side wall to increase or decrease the effective volume of space within the container.

4 Claims, 2 Drawing Sheets

CONTAINER HAVING EXPANDING OR CONTRACTING END CLOSURE

CROSS-REFERENCE TO RELATED APPLICATION

This application is a continuation-in-part of application Ser. No. 09/036,666, filed Mar. 4, 1998.

FIELD OF THE INVENTION

This invention relates to a container for packaging various products, including food products, and which is characterized by having an end closure on at least one end of the container which contracts or expands to accommodate expansion or contraction of the product packaged within the container.

BACKGROUND OF THE INVENTION

Containers utilized for packaging various products, including food products, are often subjected to increased or decreased pressure within the container which results from either the product being packaged under a vacuum or the product expanding after it is placed in the container. This is typical of food products in which as much air as possible is pulled out of the container so that the product is under a vacuum or the packaging of a food product, such as a dough or the like, wherein the product expands after packaging.

Composite containers including at least a paper body layer and a barrier liner layer and closed by paper end members also having barrier liner layers or metal end members are becoming increasingly more popular for packaging various products, including food products. These container constructions include problems with the walls of the body portion buckling outwardly under increasing pressure within the container resulting from product expansion or contracting inwardly when a vacuum is pulled on a product being packaged within the container. Composite container body portions, while providing economic advantages, do not provide the strength of metal or plastic containers. Even the metal or plastic containers can have the problems of buckling or contracting side walls due to the above changing conditions within the container.

OBJECT AND SUMMARY OF THE INVENTION

Accordingly, it is the object of this invention to provide a container construction which overcomes the above problems and accommodates expansion or contraction of product packaged within the container.

It has been found by this invention that the above object may be accomplished by providing a container having a movable end closure for accommodating expansion or contraction of product contained within the container by increasing or decreasing the effective volume of space within the container and comprising the following. An elongate body portion has opposed open ends and an inside surface. An end closure is positioned at each of the open ends of the hollow body portion and is secured thereto for closing the container with the product contained therein. One of the end closures is of a generally cup-shaped configuration having a radially-extending central portion of generally the same configuration and dimensions as the open end of the body portion and an accordion-folded side wall extending axially from the central portion toward the body portion open end and defining a free end area secured to the body portion at the open end and positioned so that the end closure central portion may axially move toward or away from the body portion open end by contraction or expansion of the end closure accordion-folded side wall.

Preferably, the body portion of the container and the contracting or expanding end closure are constructed of composite materials which preferably include a paper layer and a barrier liner layer.

BRIEF DESCRIPTION OF THE DRAWINGS

In the drawings which form part of the original disclosure of the invention.

DETAILED DESCRIPTION OF A PREFERRED EMBODIMENT OF THE INVENTION

In the following detailed description, two preferred embodiments of the invention are described. It will be understood, however, that the invention is not to be limited to these preferred embodiments and although specific terms are employed in describing these preferred embodiments, these terms are used for purposes of illustration only and not for purposes of limitation. It will be apparent that the invention includes various alternatives, modifications and equivalents within the spirit and scope as will be apparent to skilled artisans.

Figure 1:
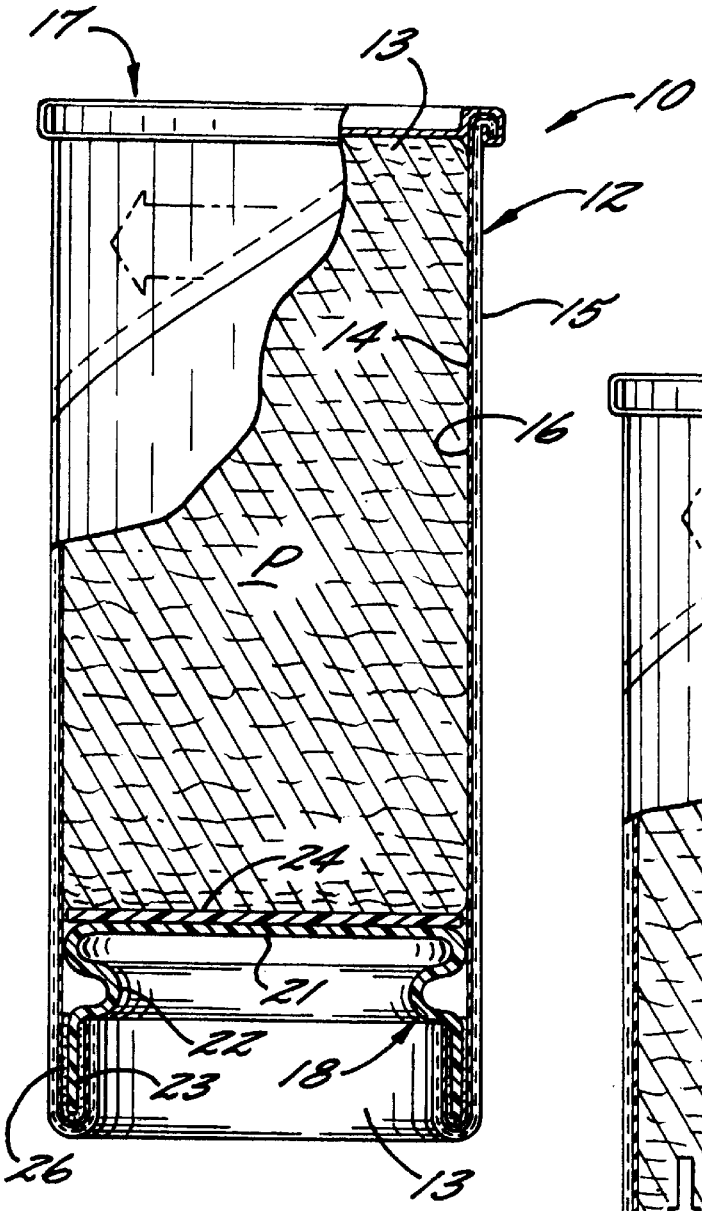
FIG. 1 is an elevational view, mostly in section, of a first embodiment of a container construction in accordance with this invention and having a movable end closure in an expanded position resulting from a vacuum being pulled on the product contained within the container.
Figure 2:
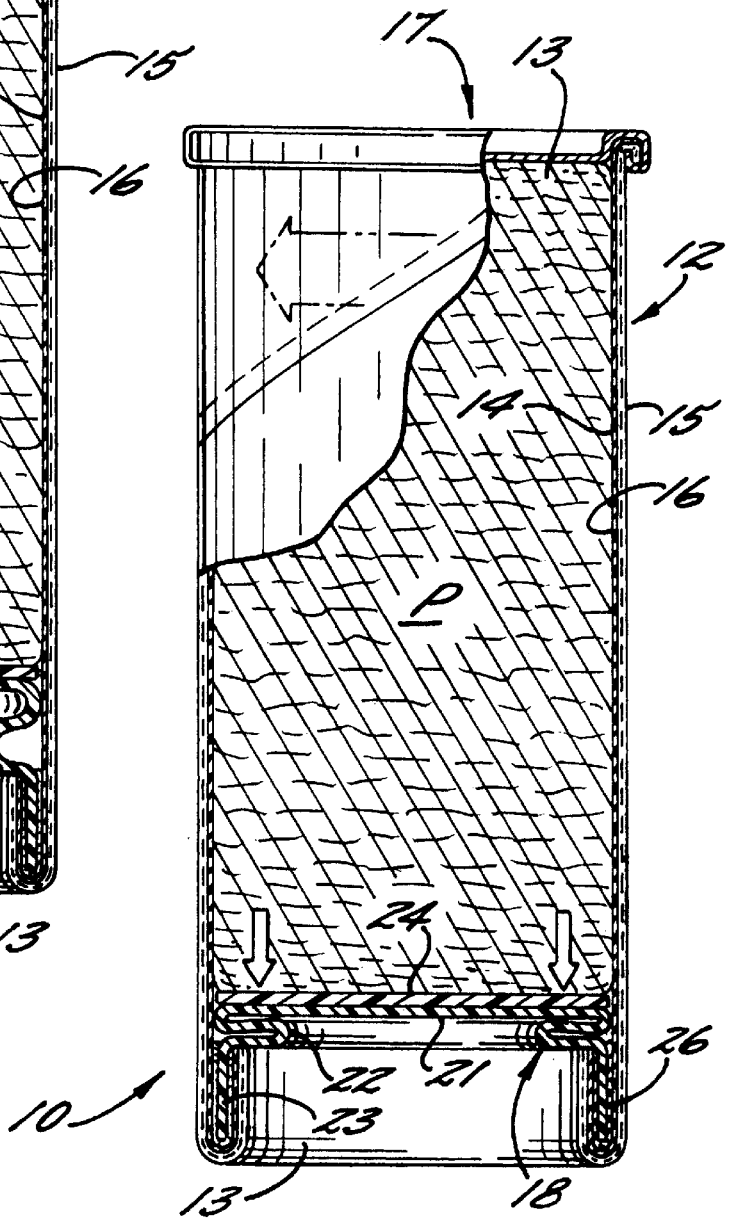
FIG. 2 is an elevational view, mostly in section, illustrating the first embodiment of the container illustrated in FIG. 1 with the movable end closure in a contracted position resulting from expansion of the product contained within the container.

FIGS. 1 and 2 illustrate a first preferred embodiment of a container, generally referred to at 10, constructed in accordance with the present invention. This container 10 includes an elongate hollow body portion 12, preferably tubular in configuration, having opposed open ends 13 and an inside surface 14. The body portion 12 may be constructed of any suitable materials including or plastic, but is preferably constructed of spirally-wound composite materials including a paperboard layer 15 and a barrier line layer 16 in superimposed position inside the paperboard layer 15.

The paperboard layer 15 may be composed of conventional spiral-winding paperboard or board stock having a thickness of between 0.010 and 0.042 inch, preferably between 0.015 and 0.030 inch, for example 0.021 inch. The barrier liner layer 16 may advantageously comprise a flexible material such as a polymer, a metalized polymer, a silicate impregnated polymer or a lamination of property enhancing polymers or polymer coatings on polymers, foils or paper, lamination of paper, metalized paper, polymer, metalized polymer, silicate impregnated polymer or foil engineered in combination to achieve the desired level of barrier. The container 10 further includes end closures 17, 18 positioned at each of the respective open ends 13 of the hollow body portion 12 and secured thereto for closing the container 10 with product P contained therein.

One of the end closures 18 is of a generally outwardly-facing cup-shaped configuration positioned inside the hollow body portion 12 and has a radially-extending central portion 21 of generally the same configuration and dimensions (e.g., circular with the same diameter) as the inside surface 14 of the body portion 10. The end closure 18 further includes an accordion-folded side wall 22 extending axially from the central portion 21 toward the body portion free end 13 and defining a free end area 23 which is secured to the inside surface 14 of the body portion 12 at the open end 13 and positioned so that the end closure central portion 21 may axially move along the body portion inside surface 14 toward or away from the body portion open end 13 by contraction or expansion of the end closure accordion-folded side wall 22 to increase or decrease the effective volume of space within the container 10, as shown in FIGS. 1 and 2, respectively.

The one end closure 18 may be constructed of any suitable materials which can be utilized to form the expanding and contracting accordion-folded side wall 22 and otherwise perform as described above. This end closure 18 may also include a disk-like member 24 secured to the radially extending central portion 21. The end closure 18 is preferably constructed of composite materials which may be the same as that utilized for construction of the hollow body portion 12, as described above, or may include suitable layers of paper (25#/ream or 25# bleached kraft), low density polyethylene, foil (0.00035" aluminum) or film (metalized polyethyleneterephtalate) and polyethylene (10–20#/ream SURLYN).

The cup-shaped end closure 18 is preferably secured to the open end 13 of the hollow body portion 12 by providing the open end 13 of the body portion 12 with a inwardly curled U-shaped cross-sectional configuration (as illustrated in FIGS. 1 and 2) so that the free end area 23 of the cup-shaped end closure 18 may be positioned within the inwardly-curled U-shaped body portion end 13 and an adhesive, generally indicated at 26 is positioned within the U-shaped body portion end 13 to secure the free end area 23 of the end closure 18 therein.

The other end closure 17 is preferably a paper or metal (steel or the like) conventional end closure double seamed to the open end 13 in a manner well understood by those with ordinary skill in the art or may be constructed of any suitable material and secured to the open end in any suitable manner.

Figure 3:
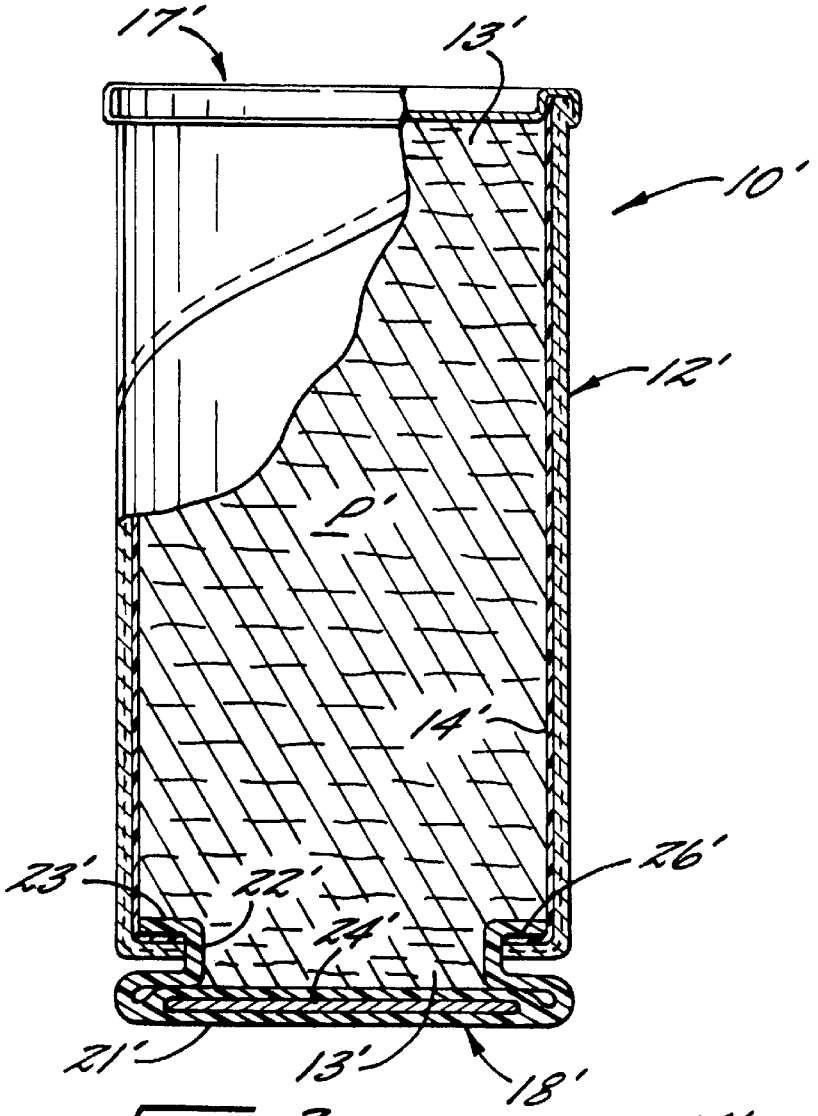
FIG. 3 is an elevational view, mostly in section, of a second embodiment of a container constructed in accordance with this invention and having a movable end closure in a contracted position resulting from a vacuum being pulled on the product contained within the container.
Figure 4:
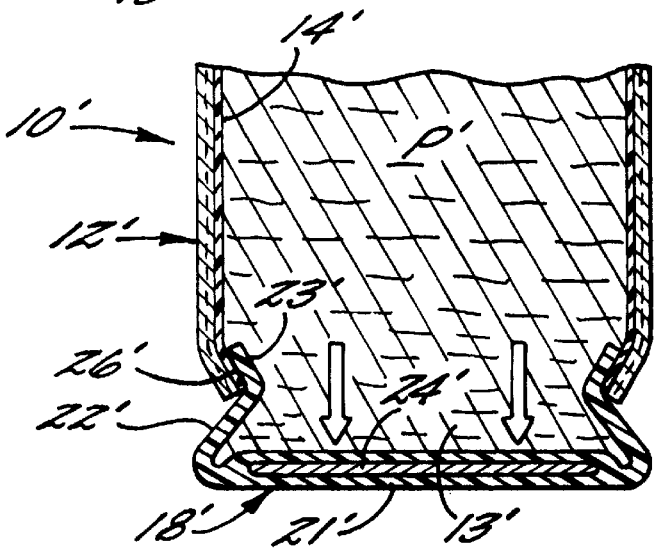
FIG. 4 is a partial elevational view, in section, illustrating the container of FIG. 3 with the movable end closure in an expanded condition resulting from expansion of the product contained within the container.

FIGS. 3 and 4 illustrate a second preferred embodiment of a container, generally referred to at 10', constructed in accordance with the present invention. This second embodiment of container 10' includes many of the same features as the first embodiment of a container 10 illustrated in FIGS. 1 and 2 and like reference characters will be utilized for like components with prime notations for the second embodiment of container 10' illustrated in FIGS. 3 and 4.

Generally, the container 10' includes an elongate hollow body portion 12', preferably tubular in configuration, having opposed open ends 13' and an inside surface 14'. The body portion 12' may be constructed of suitable materials as described above in connection with the first embodiment of container 10. The container 10' further includes end closures 17', 18' positioned at each of the respective open ends 13' of the hollow body portion 12' and are secured thereto for closing of the container 10' with product P' contained therein. One of the end closures 18' is of a generally inwardly-facing cup-shaped configuration positioned for the most part outside the hollow body portion 12' and has a radially-extending central portion 21' of generally the same configuration and dimensions as the open end 13' of the body portion 12'. The end closure 18' further includes an accordion-folded sidewalk 22' extending axially from the central portion 21' toward the body portion free end 13' and defines a free end area 23' which is secured to the inside surface 14' of the body portion 12' at the open end 13' and positioned so that the end closure central portion 21' may axially move away from and toward the body portion open end 13' by expansion or contraction of the end closure accordion-folded sidewalk 22' to increase or decrease the effective volume of space within the container 10', as shown clearly in FIGS. 3 and 4.

The one end closure 18' may be constructed of suitable materials, described above with respect to the first embodiment of container 10 and may include a disk-like member 24' secured to or incorporated within the radially extending central portion 21'.

The cup-shaped end closure 18' is preferably secured to the open end 13' of the hollow body portion 12' by providing the open end 13' of the body portion 12' with a generally inwardly-turned L-shaped cross-sectional configuration (as illustrated in FIG. 3) so that the free end area 23' of the cup-shaped end closure 18' may be positioned within the inwardly-turned L-shaped body portion end 13'. An adhesive, heat seal or other bond, generally indicated at 26' is positioned between the inwardly-turned portion of the L-shaped body portion end 13' and the free end area 23' of the end closure 18' to bond and secure these components together.

The other end closure 17' may preferably be paper or metal, as discussed above in connection with the first embodiment of container 10.

This invention has been described in considerable detail with reference to its preferred embodiment. However, variations and modifications may be made within the scope and spirit of this invention as described in the foregoing specification and as defined in the following claims.

What is claimed is:

1. A container having a moveable end closure for accommodating expansion or contraction of product packaged therein and comprising:

an elongate hollow body portion having opposed open ends and an inside surface;

an end closure positioned at each of said open ends of said hollow body portion and secured thereto for closing said container with product contained therein; and one of said end closures being movable and of a generally inwardly facing cup-shaped configuration positioned for the most part outside said hollow body portion and defining a flat central portion of generally the same configuration and dimensions as said open end of said body portion and extending radially of said body portion, and an accordion-folded side wall which is integral with and extends perpendicularly from said central portion and axially toward said body portion open end and defines a free end area which is secured to said inside surface of said body portion at said open end and is positioned so that said end closure central portion may axially move away from and toward said body portion open end by axial expansion or contraction of said end closure accordion-folded side wall to increase or decrease the effective volume of space within said container and respectively increase or decrease the effective volume of space within said cup-shaped movable end closure.

2. A container, as set forth in claim 1, in which said body portion of said container is constructed of composite materials and said contracting or expanding end closure is constructed of composite materials.

3. A container, as set forth in claim 2, in which said composite materials of said body portion and said end closure include a paper layer and a barrier liner layer.

4. A container, as set forth in claim 1, in which said opposed end of said body portion having said contracting or expanding end closure defines a generally inwardly-turned L-shaped cross-sectional configuration, said free end of said cup-shaped end closure is positioned within said inwardly-turned L-shaped body portion end, and a bond secures said free end of said end closure to said opposed end.

* * * * *